US005331955A

United States Patent [19]

Lewis

[11] Patent Number: 5,331,955

[45] Date of Patent: Jul. 26, 1994

[54] AIR TANK ADAPTER FOR CONVERTING A SELF-CONTAINED BREATHING APPARATUS TO A SELF-CONTAINED UNDERWATER BREATHING APPARATUS

[76] Inventor: Albert L. Lewis, RD#3, Box 6741, Barre, Vt. 05641

[21] Appl. No.: 831,166

[22] Filed: Feb. 5, 1992

[51] Int. Cl.[5] ..... A61M 15/00

[52] U.S. Cl. ..... 128/200.24; 128/201.27; 128/202.27

[58] Field of Search ..... 137/505, 507, 505.25, 137/884; 128/201.27, 201.28, 205.24, 204.26, 200.24, 202.27

[56] References Cited

U.S. PATENT DOCUMENTS

| | | | |
|---|---|---|---|
| 3,561,477 | 2/1971 | Pinto | 137/505.25 |
| 3,698,425 | 10/1972 | Fisher | 137/505.25 |
| 3,799,189 | 3/1974 | Christianson | 137/505.25 |
| 4,192,298 | 3/1980 | Ferraro et al. | 137/505.25 |
| 4,351,327 | 9/1982 | Rinne et al. | 137/884 |
| 4,887,645 | 12/1989 | Kerger | 137/884 |
| 5,176,169 | 1/1993 | Ferguson | 137/507 |
| 5,190,030 | 3/1993 | Semeia | 128/201.28 |

*Primary Examiner*—Edgar S. Burr
*Assistant Examiner*—Aaron J. Lewis
*Attorney, Agent, or Firm*—S. Michael Bender

[57] ABSTRACT

An air tank adapter is designed to facilitate the use of self-contained breathing apparatus (SCBA) air tanks with a self-contained underwater breathing apparatus (SCUBA).

4 Claims, 7 Drawing Sheets

AIR TANK ADAPTER FOR CONVERTING A SELF-CONTAINED BREATHING APPARATUS TO A SELF-CONTAINED UNDERWATER BREATHING APPARATUS

BACKGROUND OF THE INVENTION

1. Field of the Invention

The present invention relates to breathing apparatuses, and more particularly pertains to an adapter which facilitates a use of SCBA air tanks with a SCUBA regulator.

2. Description of the Prior Art

Throughout the United States as well as world wide, local fire departments and rescue organizations provide the emergency services for rescues of victims of water, underwater and ice accidents. All of these departments carry and use self-contained breathing apparatus (SCBA) which is used for fire fighting and in other noxious environments. Although the air tank cylinders for both fire fighting and underwater diving are virtually the same due to Department of Transportation (DOT), OSHA, and other federal regulations, they cannot be used for the dual purpose of both above water and underwater breathing. The problem is that the cylinder valve assemblies are designed for the connection of different high pressure air lines, and this problem forces fire and rescue departments to purchase redundant air supply systems to satisfy emergency needs. As can be appreciated, this constitutes a costly and sometimes unaffordable situation and accordingly, there exists a need for developing a single system whereby the same air tanks could be utilized in both above water and underwater situations. In this respect, the present invention substantially fulfills this need.

SUMMARY OF THE INVENTION

In view of the foregoing disadvantages inherent in the known types of self-contained breathing systems now present in the prior art, the present invention provides an improved adapter assembly wherein the same can be utilized to allow the use of a self-contained breathing apparatus air tank with self-contained underwater breathing apparatus. As such, the general purpose of the present invention, which will be described subsequently in greater detail, is to provide a new and improved adapter assembly for allowing a use of SCBA air tanks in a SCUBA environment.

To attain this, the present invention essentially comprises an air tank adapter which is designed to facilitate the use of self-contained breathing apparatus (SCBA) air tanks with self-contained underwater breathing apparatus (SCUBA). The capability to implement this conversion can have many far reaching ramifications—to the point of actually saving a life in given circumstances while also being economically effective for fire fighting organizations. In addition to their primary responsibilities, fire fighters are also responsible for underwater rescue operations and they maintain a small supply SCUBA air tanks for this purpose. However, there is no assurance that an adequate supply of tanks will be available for a lengthy effort, and when the supply is exhausted, there is no alternative but to discontinue the operation whether or not it has been successful to that point. Further, the cost of maintaining two types of air supplies, where one is mainly redundant and seldom used, limits the effectiveness of fire fighters in conducting underwater rescue operations. As is apparent, the minimal initial expense for the present invention will be quickly offset by the monetary savings and will thus result in an ongoing economical advantage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air tank adapter which has all the advantages of the prior art air tank adapters and none of the disadvantages.

It is another object of the present invention to provide a new and improved air tank adapter which may be easily and efficiently manufactured and marketed.

It is a further object of the present invention to provide a new and improved air tank adapter which is of a durable and reliable construction.

An even further object of the present invention is to provide a new and improved air tank adapter which is susceptible of a low cost of manufacture with regard to both materials and labor, and which accordingly is then susceptible of low prices of sale to the consuming public, thereby making such air tank adapters economically available to the buying public.

Still yet another object of the present invention is to provide a new and improved air tank adapter which provides in the apparatuses and methods of the prior art some of the advantages thereof, while simultaneously overcoming some of the disadvantages normally associated therewith.

Still another object of the present invention is to provide a new and improved air tank adapter which will allow a standard SCBA air tank to be used for SCUBA.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
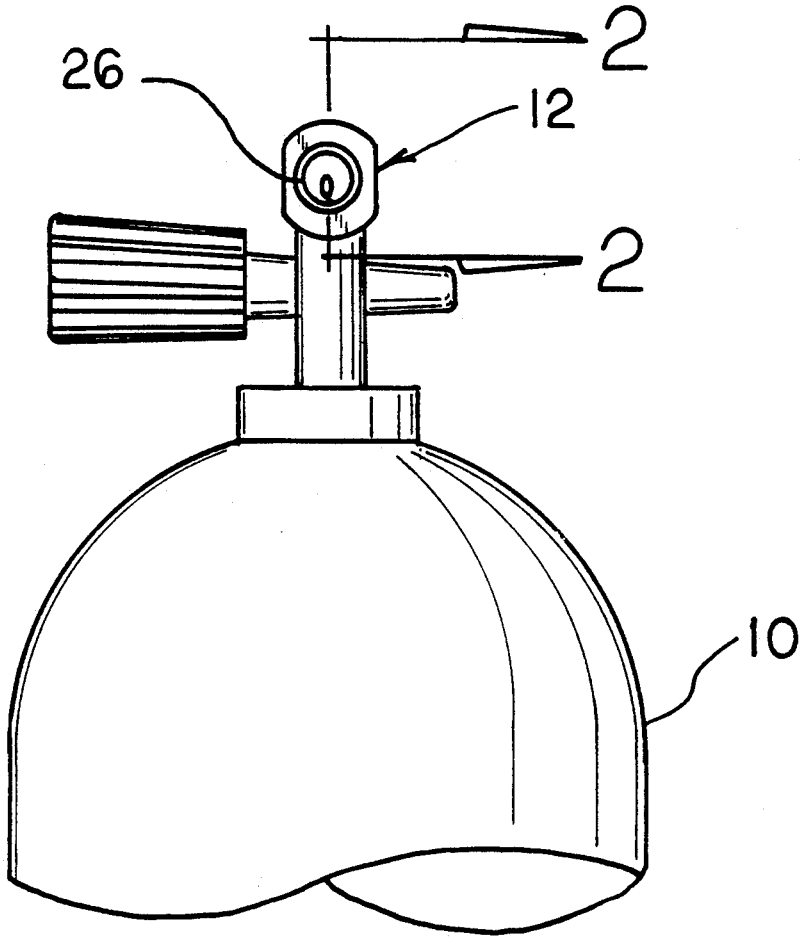
FIG. 1 is a partial front elevational view of a conventional SCUBA air tank.

With reference now to the drawings, a new and improved air tank adapter for allowing a standard SCBA air tank to be used for SCUBA embodying the principles and concepts of the present invention will be described.

To understand the construction of the present invention, it will be initially necessary to discuss the construction of various components associated with self-contained breathing apparatus (SCBA) air tanks and self-contained underwater breathing apparatus (SCUBA) air tanks. In this respect then, reference is initially made to FIGS. 1 and 2 of the drawings to understand the construction of a conventional SCUBA air tank 10 and its associated cylinder air valve assembly 12.

The cylinder air valve assembly 12 essentially comprises a solid metal block member 14 having a conically shaped indent 16 on a rear surface 18 thereof and a larger cone shaped indent 20 on a front face 22. A circular groove 24 is positioned around a peripheral edge of the conically shaped indent 20 and is designed to receive an O-ring 26. An air delivery conduit 28 communicates within an interior surface of the indent 20 and facilitates a controlled delivery of air from the cylinder 10 to a first stage regulator as will be subsequently described in greater detail. The cylinder valve assembly 12 is peculiar to the construction of SCUBA air tanks and differs substantially from the cylinder valve assemblies associated with SCBA air tanks as will also be subsequently described.

Figure 2:
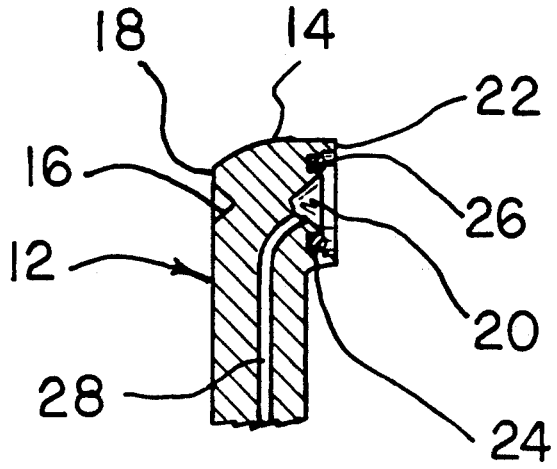
FIG. 2 is a cross-sectional view of the cylinder valve assembly associated with a SCUBA air tank as viewed along the line 2—2 in FIG. 1.
Figure 3:
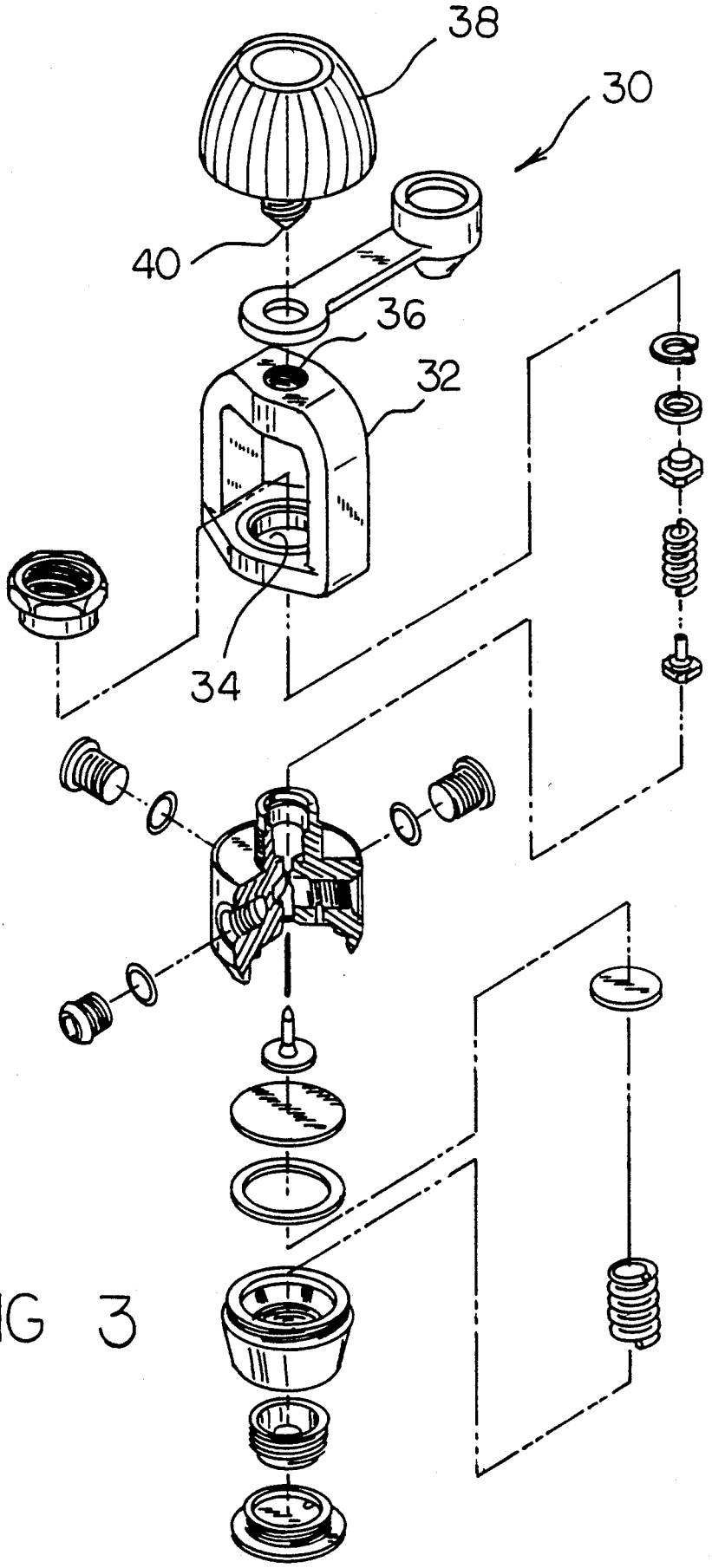
FIG. 3 is an exploded view of a conventional SCUBA first stage regulator.

FIG. 3 of the drawings illustrates an exploded view of a first stage regulator 30 which is removably attachable to the cylinder valve assembly 12 shown in FIGS. 1 and 2. The regulator 30 includes a yoke 32 which is positionable over the cylinder valve block 14 so that the aperture 34 is aligned with the O-ring 26. This positioning of the yoke 32 also includes aligning the threaded aperture 36 with the indent 16 on the block 14, and the threadably movable knob 38 may then be rotated to bring the pointed shank 40 into the indent 16. This effects a tightening of the aperture 34 against the O-ring 26 so that air may be released from the tank 10 into the first stage regulator 30. All of the structure thus far described with reference to FIGS. 1, 2, and 3 is conventional, and such description was provided for the purposes of understanding the use and function of the present invention which will be subsequently described in greater detail.

Figure 4:
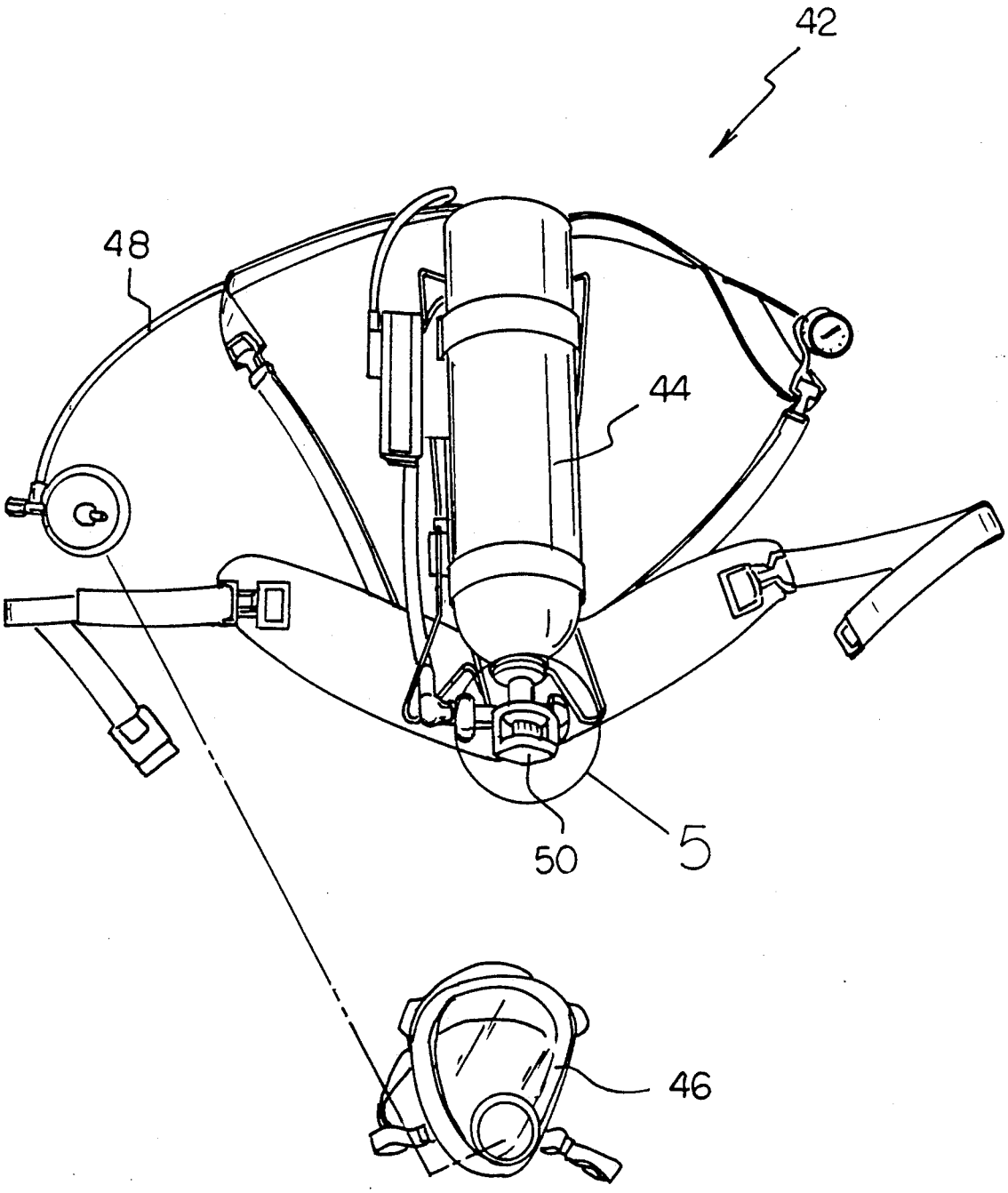
FIG. 4 is an elevational view of a conventional self-contained breathing apparatus.

Whereas FIGS. 1, 2 and 3 relate to the structure of a SCUBA air tank system, FIG. 4 of the drawings illustrates a conventional self-contained breathing apparatus (SCBA) system which is generally designated by the reference numeral 42. This system 42 typically includes a compressed air tank 44, a covering face mask 46 which is selectively attachable to the air tank 44 by an air supply hose 48, and a cylinder valve assembly 50 which regulates the air being delivered from the tank 44 to the mask 46.

Figure 5:
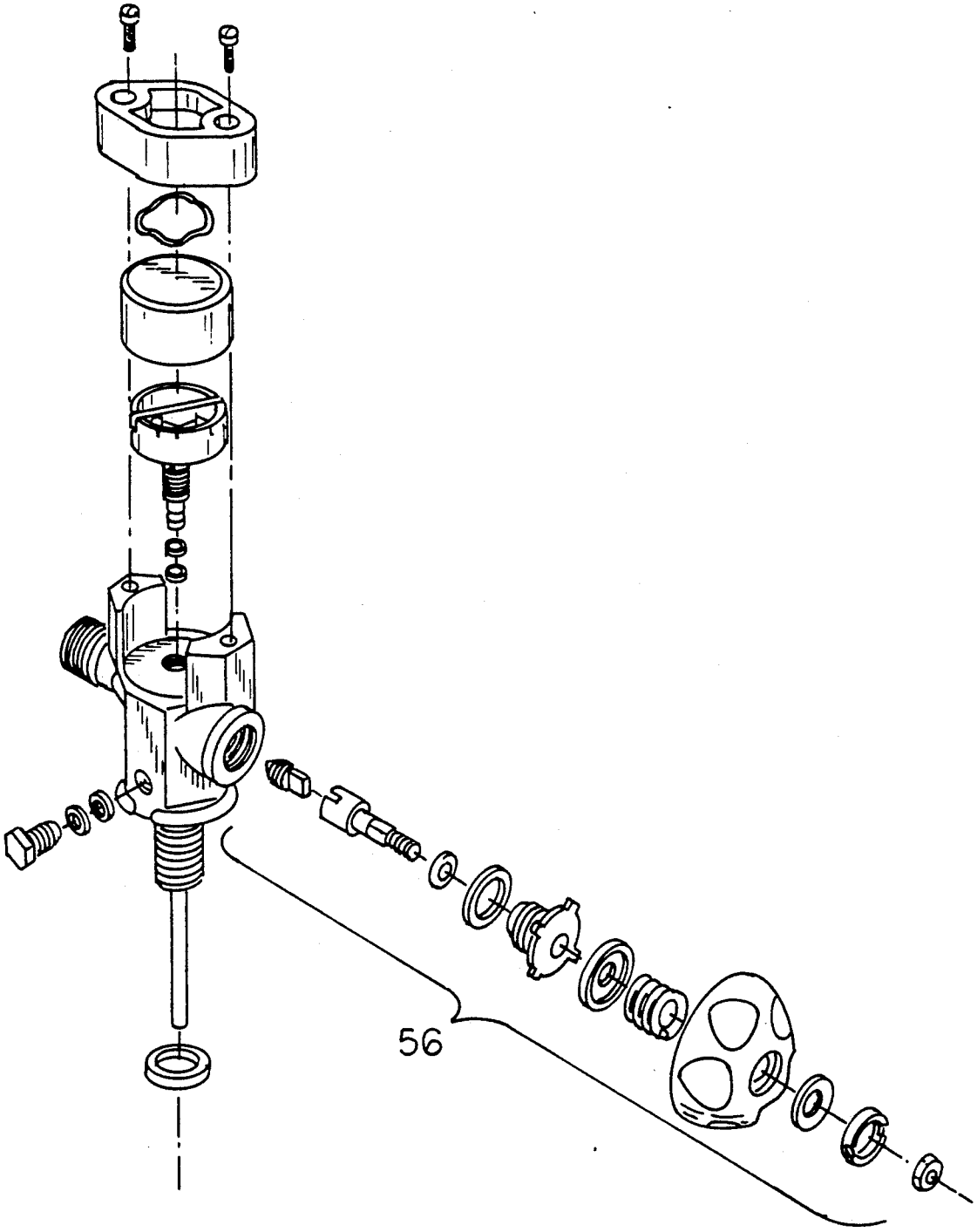
FIG. 5 is an exploded view of a cylinder valve assembly associated with the SCBA shown in FIG. 4.
Figure 6:
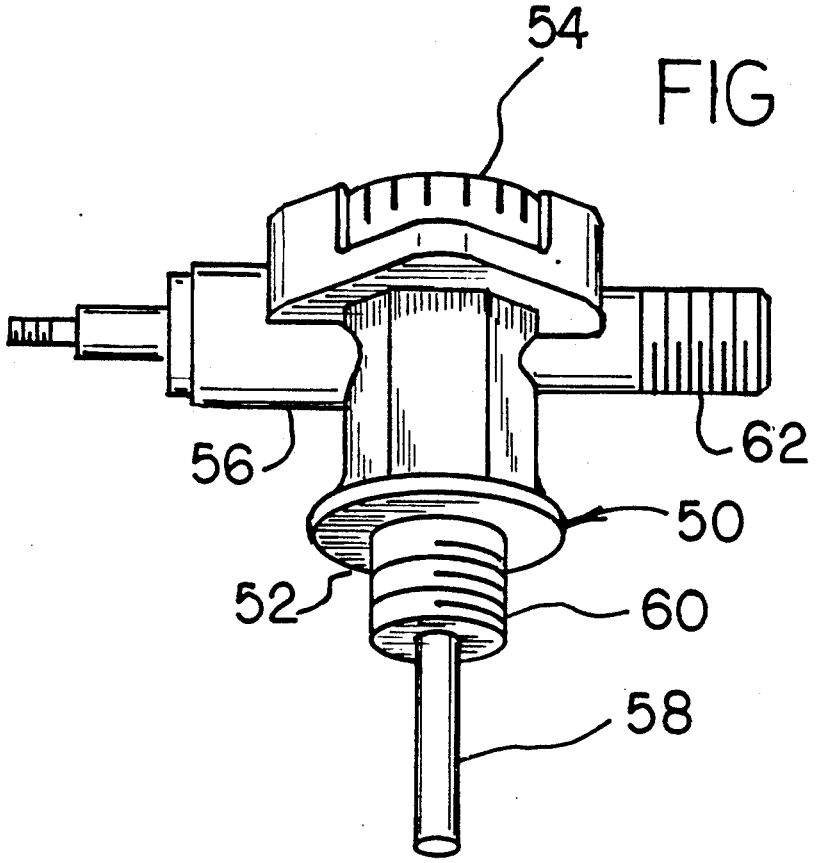
FIG. 6 is an elevational view of the cylinder valve assembly shown in FIG. 5.

FIGS. 5 and 6 more particularly illustrate the construction of the SCBA air valve assembly 50. As is shown, the air valve assembly 50 includes a valve body 52 in which is mounted a visible air pressure gauge 54 and a manually-controlled air release valve 56. A dip tube 58 is positionable inside a SCBA air tank 44, and the valve body 52 is threadably attached to the SCBA air tank by means of integral threads 60. A CGA outlet 62 is designed to receive an air delivery hose 48 as shown in FIG. 4, and such attachment of the air hose to the CGA outlet is by threaded connection as is now apparent.

With concurrent reference to FIGS. 4–7, it will be understood that the air hose 48 may be attached to the CGA outlet 62 by means of a brass regulator inlet nut 64 and its associated nipple 66. The regulator inlet nut 64 and its internally positionable nipple 66 are of a conventional construction, and are regularly used as a cylinder connection means whereby a flexible air hose may be attached to a cylinder for the purpose of facilitating air delivery from the cylinder to a remotely positioned regulator. The brass regulator inlet nut 64 is threadably attachable to the external threads located on the CGA outlet 62 and the nipple 66, which is sealingly retained within the inlet nut 64, allows air to flow to an attached air hose 48.

Figure 8:
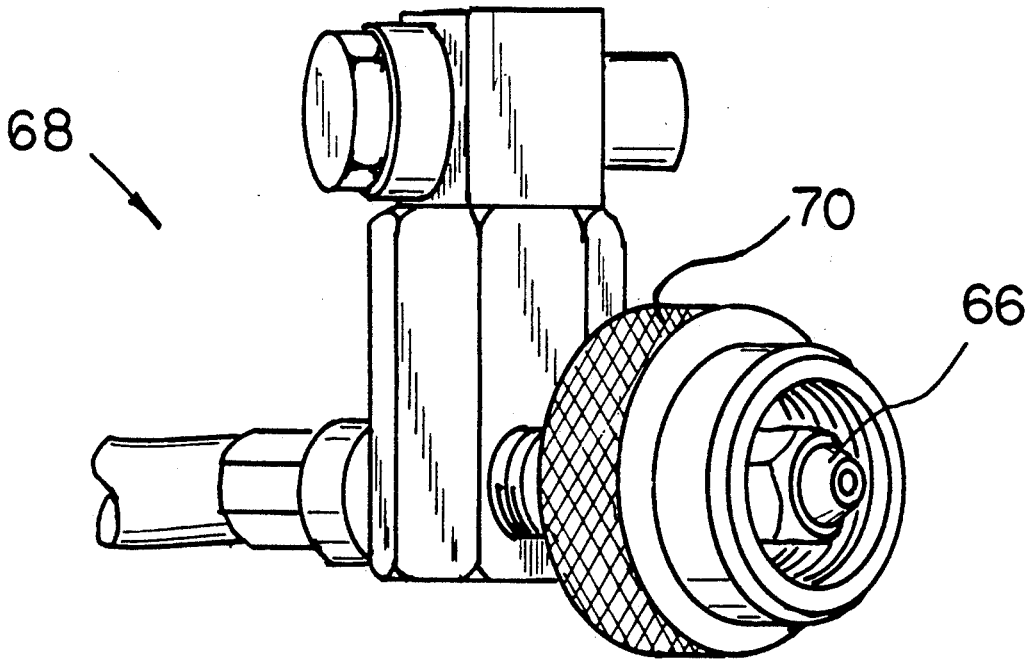
FIG. 8 is a perspective view of a conventional audible alarm and high-pressure hose assembly.

FIG. 8 of the drawings illustrates an audible alarm and high-pressure hose assembly 68 of a type which is already commercially available. This hose assembly 68 has been provided for the purpose of illustrating an inlet nut which is constructed in the manner of a hand wheel 70 to facilitate its attachment to a CGA outlet 62, and this drawing also illustrates the positioning of a conventional nipple 66 therein. The knurled construction of the inlet nut 70 facilitates a hand tightening of the hose assembly 68 to the CGA outlet 62, and as will be subsequently understood, this hand wheel nut structure 70 is of the type utilized in the combination of the present invention. Since the nut 70 needs to only be hand tightened on a CGA outlet 62 the knurled hand wheel structure 70 eliminates the need for the use of special tools such as wrench and the like.

Figure 9:
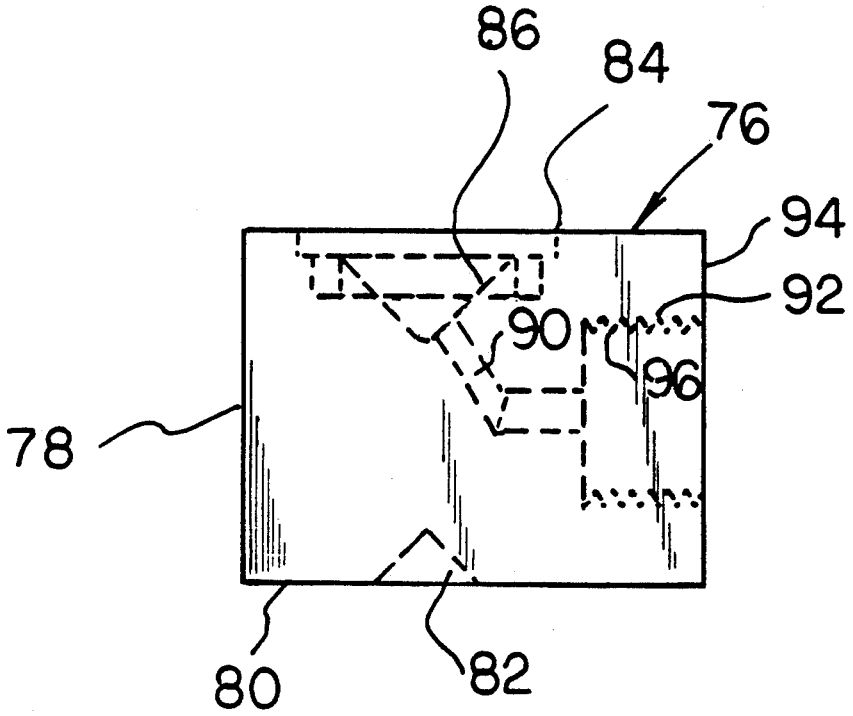
FIG. 9 is a front elevational view of an adapter forming a part of the present invention.
Figure 10:
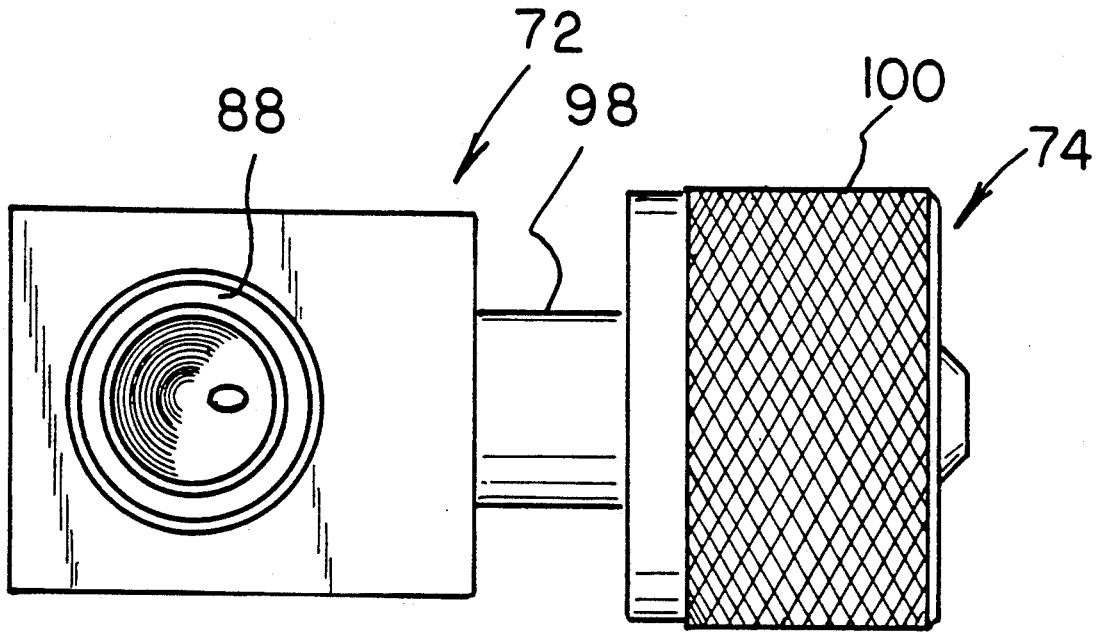
FIG. 10 is a top plan view of the present invention.
Figure 11:
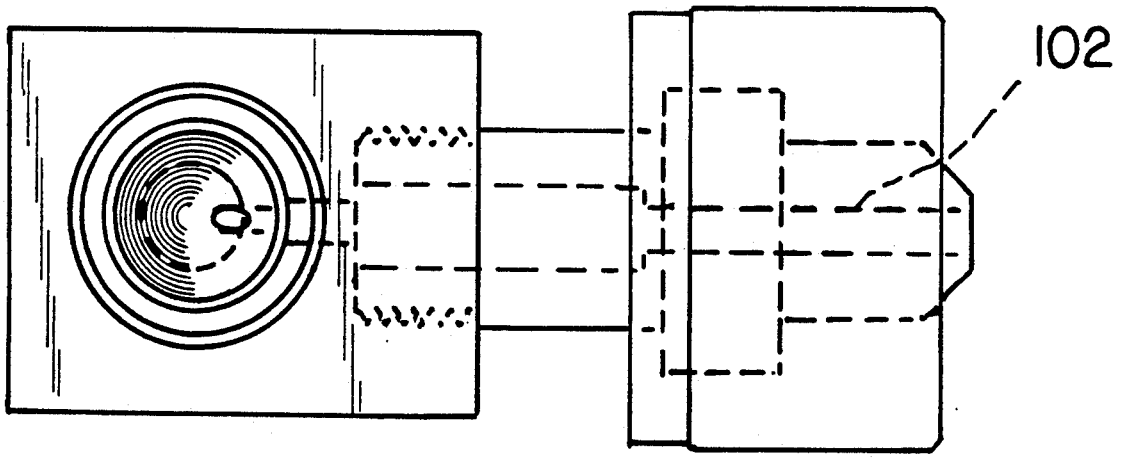
FIG. 11 is a top plan view of the present invention illustrating specific details thereof.

FIGS. 9, 10 and 11 illustrate the construction of the air tank adapter 72 comprising the present invention. In this regard, the air tank adapter 72 is formed of two major parts, i.e., an inlet nut and nipple assembly 74 and a yoke adapter 76. The yoke adapter 76 essentially consists of a metallic block 78 constructed very similarly to the cylinder valve assembly 14 as described in FIG. 2. In this respect, a rear wall portion 80 of the block 78 includes a conically-shaped indent 82, and a front wall portion 84 of the block includes a larger conically shaped indent 86. A peripheral edge of the cone-shaped indent 86 includes a circular groove 88 for receiving an O-ring, and the two indents 82, 86 are designed to receive the yoke 32 of a first stage scuba regulator 30 as shown in FIG. 3. By an appropriate turning of the regulator attachment knob 38, the first stage scuba regulator 30 may be attached to the yoke adapter 76 in a manner identical to that of a cylinder valve assembly 14 of the type illustrated in FIG. 2.

The conically-shaped indent 86 also includes a communicating aperture 90 at a bottom portion thereof and this aperture establishes fluid communication between the indent 86 and a cylindrically shaped aperture 92 formed in a sidewall 94. The cylindrically-shaped aperture 92 is provided with internal threads 96 so as to threadably receive the inlet nut and nipple assembly 74 as illustrated in FIGS. 10 and 11.

Figure 7:
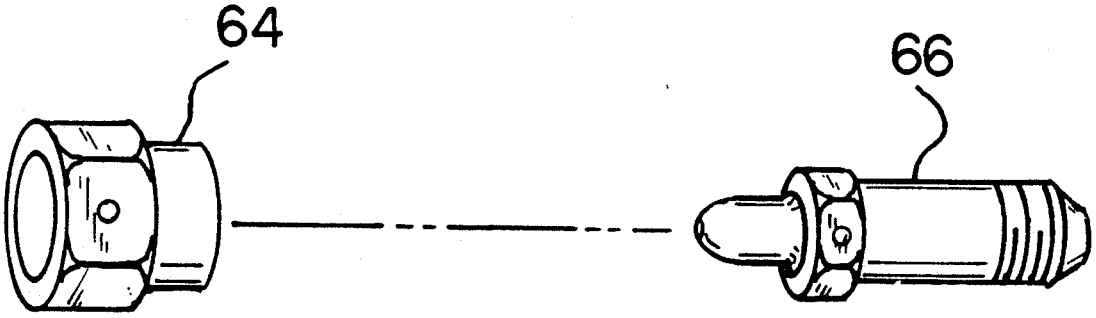
FIG. 7 is an exploded view of a conventional brass regulator inlet nut and nipple assembly.

The inlet nut and nipple assembly 74 includes a nipple 98 of the type shown in FIG. 7 with this nipple being position within a knurled, hand tightenable inlet nut 100 of the type illustrated in FIG. 8. The nipple 98 is threadably positionable within the aperture 92, and once the nipple is securely seated within the aperture, silver soldering may be utilized to seal and permanently affix the nipple to the yoke adapter 76.

In use, the air tank adapter 72 is attachable to the CGA outlet 62 of a SCBA air tank by means of the knurled inlet nut 100 whereby air may be delivered through an internal passage 102 already formed within the nipple 98. This air passage 102 is in communication with the air passage 90 whereby air may be delivered to the conically-shaped indent 86 formed in the yoke adapter 76. Since the yoke adapter 76 is substantially identical in construction to a cylinder valve assembly 14 of the type shown in FIG. 2, a first stage SCUBA regulator 30 of the type shown in FIG. 3 may be attached to the yoke adapter whereby the SCBA air tank may now be employed as a SCUBA air tank.

In summary, the device 72 will allow a standard SCBA air tank 44 to be used for SCUBA since the major manufacturers of fire fighting self-contained breathing apparatus systems utilize the same type and size CGA outlets 62 for their cylinders. The present invention essentially comprises an adaptor 72 which will allow a connection to be made from the CGA outlets 62 and provide a body assembly for the standard SCUBA yoke assembly 32, thus eliminating the need for redundant air supply systems for different environments.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved air tank adaptor for allowing a self-contained air breathing apparatus (SCBA) air tank to be used as a self-contained underwater breathing apparatus (SCUBA) air tank, said air tank adaptor comprising:

a yoke adapter to which a conventional first stage SCUBA air pressure regulator may be attached to receive air from a conventional SCBA air tank;

said yoke adapter comprising a block member having at least first, second and third sides;

said first side of said block member having a first conical indent;

said second side of said block member having a threaded receptacle;

said third side of said block member having a second conical indent larger than said first conical indent whereby said conventional first stage SCUBA air pressure regulator may be attached to said first and second conical indents of said block member;

a conduit in said block member extending between said second conical indent in said second side of said block member and said threaded receptacle in said second side of said block member; and coupling means attachable to said block member between said threaded receptacle and the outlet of said conventional SCBA air tank.

2. The new and improved air tank adaptor of claim 1 wherein said coupling means comprises a longitudinally extending nipple having first and second opposed ends and a passageway extending between said first and second ends, said first end adapted to be threadedly received within said threaded receptacle in said second side of said block member whereby said passageway is in communication with said conduit, and threaded nut fastener means mounted on said nipple for selectively attaching said second opposed end of said nipple to said outlet of said conventional SCBA air tank.

3. The new and improved air tank adaptor of claim 2 further including a circular groove in the periphery of said second conical indent and O-ring sealing means in said groove.

4. The new and improved air tank adaptor of claim 3 wherein said first end of said nipple adapted to be threadedly received within said threaded receptacle in said second side of said block member is sealed therein by silver solder.

* * * * *